US006949058B2

(12) United States Patent
Dumusc et al.

(10) Patent No.: US 6,949,058 B2
(45) Date of Patent: Sep. 27, 2005

(54) FEEDING AND ALIGNING DEVICE FOR A FOLDER-GLUER

(75) Inventors: Pascal Dumusc, Vionnaz (CH); Pascal-Alexandre Marciano, Echandens (CH)

(73) Assignee: Bobst S.A. (CH)

( * ) Notice: Subject to any disclaimer, the term of this patent is extended or adjusted under 35 U.S.C. 154(b) by 0 days.

(21) Appl. No.: 10/406,665

(22) Filed: Apr. 2, 2003

(65) Prior Publication Data

US 2003/0203797 A1 Oct. 30, 2003

(51) Int. Cl.[7] ..... B31B 1/60
(52) U.S. Cl. ..... 493/150; 493/394
(58) Field of Search ..... 493/150, 394; 53/52

(56) References Cited

U.S. PATENT DOCUMENTS 2,915,950 A 12/1959 La Bombard
3,326,095 A 6/1967 Lopez
3,662,655 A 5/1972 Karl et al.

FOREIGN PATENT DOCUMENTS

DE 198 28 821 12/1999
GB 1 559 213 1/1980

OTHER PUBLICATIONS

European Search Report, Jul. 3, 2003.

*Primary Examiner*—John Paradiso
(74) *Attorney, Agent, or Firm*—Ostrolenk, Faber, Gerb & Soffen, LLP

(57) ABSTRACT

A feeding and aligning device for a folder-gluer of blanks of folded and pasted cardboard boxes has at least one thrust to stop the blanks in order to crosswise align the angles between the various fold-pasted parts thereof before introducing them into a delivery area where these blanks are pressed. A mechanism introduces the blanks into the delivery area. The thrust has a driving mechanism that defines a moving trajectory for the thrust above the blanks, forming an acute angle with the conveying direction of these blanks which are moved by a conveyor that moves it along the conveying direction.

8 Claims, 3 Drawing Sheets

12
11
9c
6
5
7
8
10
9b
9a
F1
4
2
3
1

12
11
5
9c
6
7
8
10
9b
4
2
3
9a
1

12
11
9c
6
5
8
7
10
9b
2
3
9a
4

FEEDING AND ALIGNING DEVICE FOR A FOLDER-GLUER

BACKGROUND OF THE INVENTION

The present invention relates to a feeding and aligning device for a folder-gluer of blanks of folded and pasted cardboard boxes. It concerns at least one thrust that serves for stopping the blanks in order to crosswise locate and set the angles between the various fold-pasted parts, before introducing them into a delivery area where these blanks are pressed. The invention further refers to a driving mechanism for introducing the blanks into the delivery area.

The folder-gluers for blanks of cardboard boxes include one or more thrusts located at the input of the delivery area, against which the fold-pasted blanks are stopped as they are conveyed by transfer belts of the machine. Since the thrusts extend nearly perpendicularly to the transfer belts, the orientation of the cardboard blanks reaching the thrusts is not only corrected, but the various superimposed thicknesses of the folded blank contact the thrusts, ensuring the crosswise setting of the various parts of the cardboard box between one another before the pasted parts are delivered to the area where they are finally assembled and fixed.

When the front edges of the various superimposed cardboard blanks leave the thrusts of the feeding and aligning device, their differing thicknesses do not allow the blanks to be released at the same time. As a result of this non-simultaneous release of the non-uniformly thick blanks, new distortions are generated right at the infeed time in the delivery area of the folder-gluer. To avoid this problem at the output of the delivery area, the blanks are definitively pasted to each other.

SUMMARY OF THE INVENTION

It is an object of the present invention to obviate, at least partly, the above-mentioned prior art drawbacks.

To this end, the invention provides a feeding and aligning device for a folder-gluer of folded-pasted cardboard blanks in which the thrust or thrusters retracts from the blanks at an acute angle relative to the aligned edges of the blanks, i.e., relative to the feeding direction of the blanks. Due to this special construction of the thrusts, the various layers of the folded cardboard blanks are all simultaneously released from the thrusts. Thereby, blanks travel away from the thrust to the delivery area, without their aligned front edges being disturbed by the thrusts.

Other features and advantages of the present invention will become apparent from the following description of the invention which refers to the accompanying drawings.

DETAILED DESCRIPTION OF PREFERRED EMBODIMENTS OF THE INVENTION

Figure 1:
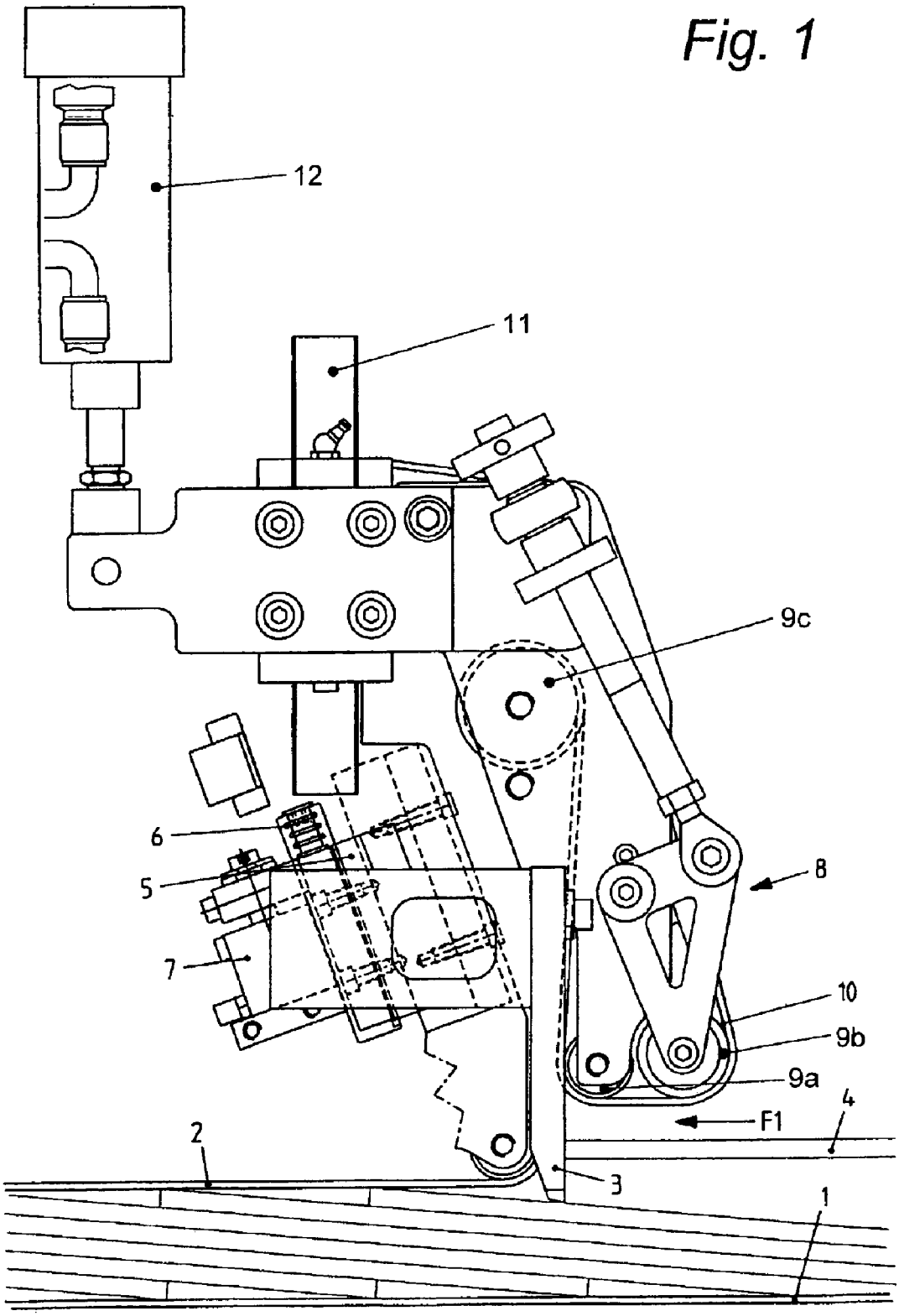
FIGS. 1 to 3 illustrate the device according to the invention during various stages of the aligning and feeding operations of the folded blanks.

Only that portion of the folder-gluer machine that relates to the feeding and aligning device is shown on the drawing. The other units of the machine being well known to those of skill in the art are assumed not to require specific description.

A lower transfer tape 1, forming a belt or a conveyor, extends along the entire delivery area of the folder-gluer. An upper transfer tape 2, forming an upper belt or conveyor, engages the blanks only after the feeding and aligning thrust 3, located slightly downstream from the input of the lower transfer tape 1. Cardboard blanks 4 are pressed between the two transfer tapes 1 and 2 which convey them in the direction of the arrow F1. The feeding and aligning thrust 3 is slidingly mounted to move along a guidance device 5 that defines a conveying trajectory or path for thrust 3 above the blanks 4, at an acute angle relative to the traveling direction of these blanks 4. See the travel direction arrow in FIG. 2. A single-action cylinder 7 allows moving the thrust 3 up along the guidance device 5, in opposition to the pressure exerted by a pull-back spring 6.

As shown in FIG. 1, a blank feeding mechanism 8 is located upstream of the thrust 3. This feeding mechanism 8 comprises an endless belt 10 arranged on rollers 9*a*, 9*b*, 9*c*, of which the roller 9*c* is the driving roller for driving the belt 10 in the direction of the F1 arrow. This feeding mechanism 8 (see also FIG. 2) is itself movingly supported on a guidance rod 11 and is movable up and down by a double-acting control cylinder 12, that is able to move the entire mechanism 8 vertically in both directions along the guidance rod 11.

In operation, at the beginning of a feeding and aligning cycle, that repeats at each arrival of a cardboard blank 4, the members of the device of the invention are positioned as shown on FIG. 1. The folded cardboard blank 4 is abutted, i.e., is stopped, against the thrust 3 at the machine production speed in order to be aligned.

Figure 2:
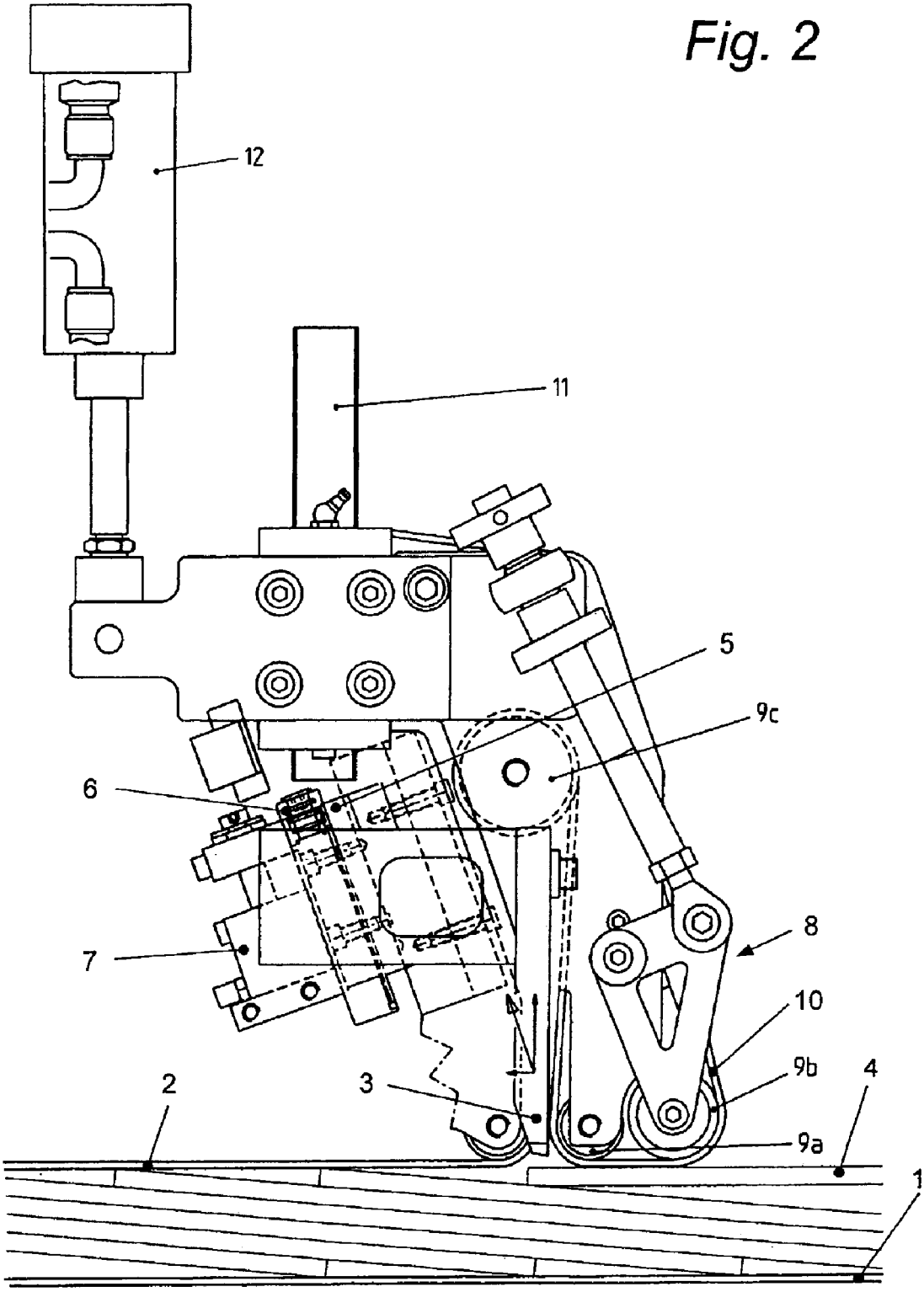

As shown on FIGS. 1 and 2, the two rollers 9*a*, 9*b* of the feeding mechanism 8, which are initially at a high vertical position, are started to move down. During this lowering motion, the endless belt 10 meets the blank 4 and urges it down while also urging it against the thrust 3. When this blank has reached the lower position illustrated on FIG. 2 and has been stopped against the thrust 3, the thrust 3 is moved upwards through the activation of the single-action cylinder 7. The thrust 3 rises along its oblique trajectory defined by the guidance rod 5. Thereby, while moving upwards, the thrust 3 simultaneously moves away from the front edge of the blank 4, thus refraining from continuing to engage one or the other layer of the folded blank 4, with the risk of distorting the shape of the blank and thus the shape of the cardboard box which will ultimately result from the pasted blank. The raising of the thrust 3 in the described directon allows the blank to be reliably fed under the upper transfer tape 2 of the delivery area, into the blanks stream 4 conveyed towards the output of the folder-gluer. During this conveying of the blanks stream 4 into the delivery area, the latter are pressed between the lower 1 and the upper 2 transfer tapes, enabling the glue to solidify completely and thus maintain tight fixing of the cardboard boxes.

Figure 3:
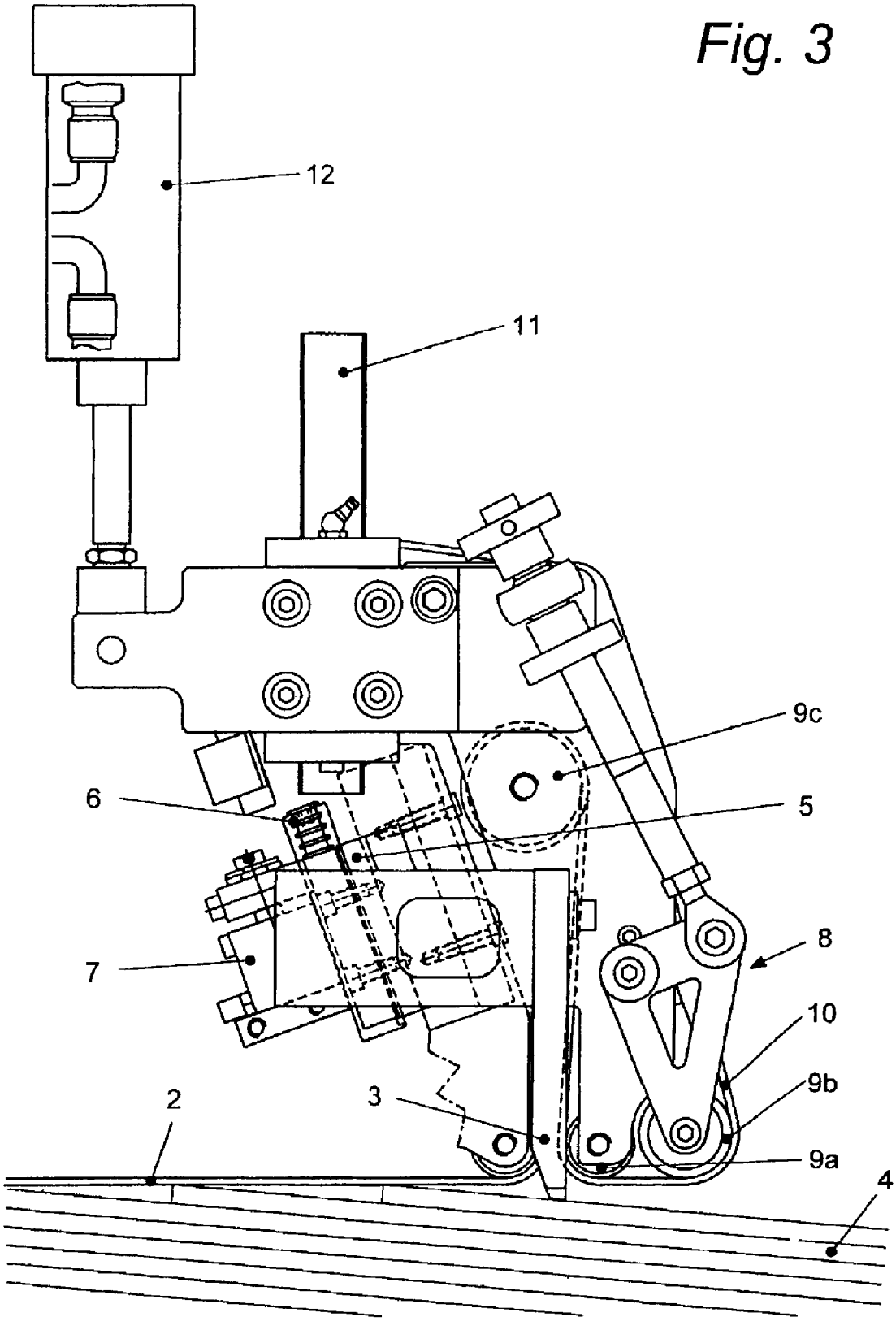

As shown on FIG. 3, as soon as blank 4 has been introduced into the blanks stream of the delivery area, the single-action cylinder 7 releases the thrust 3 which slides again along the oblique guidance rod, being urged by the pull-back spring 6, in order to be ready to engage the next blank 4.

In blank processes where blanks aligning is not required, it is sufficient to keep the two cylinders 7 and 12 inactive, so that the aligning operation is removed. In that situation, the device works in a mode of single feeding of the blanks into the delivery area.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A feeding and aligning device for an apparatus that folds and glues blanks of boxes, comprising:

at least one thrust that stops and crosswise aligns given blanks prior to their being introduced into a delivery area where these blanks are to be pressed;

a feeding mechanism for feeding the blanks; and a driving mechanism for the thrust, the thrust driving mechanism defining for the thrust a conveying path above the blanks, the conveying path forming an acute angle with a processing direction of the blanks that enables the at least one thrust to move generally vertically above and forwardly away from a blank after the blank has come to a stop against and been aligned by the at least one thrust.

2. The device of claim 1, including a vertical moving mechanism for the blank feeding mechanism that enables the blank feeding mechanism to move generally vertically upward to selectively disengage from or engage the blanks.

3. The device of claim 2, in which the driving mechanism for the blank feeding mechanism comprises a double-acting control cylinder that is structured to move in two opposite directions along a vertical conveying path.

4. The device of claim 3, which the double-acting control cylinder is maintained under pressure by a control mechanism that is able to switch it off according to the types of blanks that are processed.

5. The device of claim 1, in which the driving mechanism for the thrust comprises a single-acting cylinder that is structured to move the at least one thrust along the conveying path.

6. The device of claim 5, further including a pull-back spring that exerts a moving pressure on the at least one thrust in a direction against that exerted by the single-acting cylinder.

7. The device of claim 5, which the single-acting cylinder is maintained under pressure by a control mechanism that is able to switch it off according to the types of blanks that are processed.

8. The device of claim 1, said thrust being located and moved above the stream of blanks being prepared for said delivery area.

* * * * *